US006158698A

United States Patent [19]

Click et al.

[11] Patent Number: 6,158,698

[45] Date of Patent: Dec. 12, 2000

[54] HOLLOW TIE SWITCH ASSEMBLY

[75] Inventors: Gary Click, Birmingham, Ala.; Al Forshaw, Surrey, Canada; Brian Charles, Vancouver, Canada; Cory O'Brien, Coquitlam, Canada

[73] Assignee: VAE Nortrak North America, Inc., Cheyenne, Wyo.

[21] Appl. No.: 09/458,194

[22] Filed: Dec. 9, 1999

[51] Int. Cl.[7] ..... E01B 7/00

[52] U.S. Cl. ..... 246/449; 246/430; 246/452; 246/415 R; 238/62; 238/63

[58] Field of Search ..... 238/62, 63; 246/415 R, 246/430, 448, 449, 450, 451, 452, 382, 393

[56] References Cited

U.S. PATENT DOCUMENTS

| | | | |
|---|---|---|---|
| 450,686 | 4/1891 | Taylor et al. | 246/476 |
| 1,802,875 | 4/1931 | Conley | 246/415 R |
| 4,034,913 | 7/1977 | Hooper | 238/98 |
| 4,093,163 | 6/1978 | Larsson | 246/476 |
| 5,562,267 | 10/1996 | Heim et al. | 246/415 R |

FOREIGN PATENT DOCUMENTS

WO 94/27853 12/1994 European Pat. Off. ..... B61L 5/02

OTHER PUBLICATIONS

VAE Aktiengesellschaft No. 105993–1995.
VAE Aktiengesellschaft No. 105992–1995.
VAE Aktiengesellschaft No. 107910–1995.

*Primary Examiner*—S. Joseph Morano
*Assistant Examiner*—Frantz Jules
*Attorney, Agent, or Firm*—Fulwider Patton Lee & Utecht

[57] ABSTRACT

A hollow tie assembly for rodding associated with moveable trackwork (such as in a switch or a moveable point frog) serves the function of a tie, houses and protects throw rods, lock rods and detector rods, is adapted to accommodate North American switch machines, and does not interfere with mechanical tampers. The rodding is housed within two elongated and spaced channels which are held in predetermined spaced relationship. Switch plates straddle the flanges of each channel and the moveable rails or points are mounted on the switch plates. Rod adapters and switch clip provide a sliding connection to the moveable rails or points. The rods are made of insulating material and the switch plates and associated components include insulation to avoid cross conduction between the rails.

16 Claims, 11 Drawing Sheets

HOLLOW TIE SWITCH ASSEMBLY

TECHNICAL FIELD OF THE INVENTION

This invention relates to railway trackwork. In particular the invention relates to a control mechanism for positioning rails in machine-driven railway switches and movable point frogs.

BACKGROUND OF THE INVENTION

Machine-driven railway switches used in North America generally use some combination of three different control rods: a throw rod, a detector rod and a lock rod. The throw rod applies forces exerted by the mechanical switch-positioning machine to the moveable rails to align or position them into the desired orientation or location. The lock rod is used to fix or lock the moveable rails securely in place after positioning, while the detector rod is used to indicate the position of the moveable rails to automated signaling systems. The rods typically occupy two adjacent cribs, or area between ties, with the throw rod being located in one crib and the lock and detector rods being located in the other crib. Cribs are normally filled with ballast in the absence of these operating rods.

The location of the rods in the cribs provides unobstructed access to the rods, in accordance with U.S. Federal Railway Administration and Transport Canada regulations relating to track construction and inspection. In order to maintain such unobstructed access and to avoid interfering with the operation of the rods, ballast is usually not provided in the cribs in which the rods are located. However the absence of ballast results in faster deterioration of the track geometry and stability. The problem is compounded by the fact that the presence of the rods in the cribs prevents mechanical tamping of the track near the rods. The inability to adequately tamp or compact the ballast combined with the reduced support and stability due to the lack of ballast results in rougher riding track, an acceleration of track wear and of damage to individual track components.

Changes in ambient temperatures cause steel rails to expand or contract with corresponding and potentially high forces. These forces may cause the rails to move along their length across the tops of the ties, thus carrying the attached control rods along the rails as they reposition themselves relative to the ties. This movement may force the rods into the side of the tie resulting in the rod rubbing against the tie surface. Such rubbing causes rapid deterioration of both the rods and the ties, sometimes resulting in electrical short circuits in the track signals. Additionally the interference between the operating rods and the ties may increase the forces required to reposition the moveable rails in excess of the force available from the switch machine.

In Europe, switches usually include several rods, for example a throw rod and two detector rods. In order to allow tamping and the use of ballast in the vicinity of the switch, and to protect the rod, it is known to seat the rod in a single hollow, channel-shaped metal tie, commonly referred to as a "hollow tie". This approach results in a hollow tie which is relatively wide. The widths of European style hollow ties would interfere with tamping equipment used in North America.

The desirability of a hollow tie concept compatible with the unique North American style of railway trackwork has been recognized for some time. However to date no practical implementation of the concept has been achieved. One perceived problem has been that an inordinately wide hollow tie would be required to accommodate the throw rod, lock rod and detector rod used in North American trackwork. Ties appreciably wider or deeper than the standard wooden or concrete ties presently used in North American trackwork or ties having little or no space between adjacent units will not allow mechanical tamping to be performed. Thus, any design for a hollow tie section should address the objective of allowing mechanical tamping in the area of the moving rail sections of the switch.

Other objectives in designing a hollow tie mechanism for moving rails and points include maintaining electrical insulation between the two rails and the switch machine and allowing for misalignment of the throw rods, lock rods, and detector rods due to thermal expansion of the rails to which the rods are attached. Additionally the hollow tie design should be adaptable to the manufacturing details of existing trackwork components to allow retrofitting, it should make use of unmodified switch machines presently in railroad inventories, it should be adaptable for use at multiple locations in a railway switch and it should provide mechanical assist rods in a multiplicity of locations within the trackwork component.

The foregoing objects are addressed by the present invention, which represents a successful application of the hollow tie concept to machine driven railway trackwork comprising throw rods, detector rods and lock rods. The hollow tie according to the invention provides unobstructed access to the rods for repair, adjustment or replacement, allows mechanical tamping near the moving rails, protects the rods during mechanical tamping operations, allows ballast in the cribs, and overcomes the problem of the rods rubbing against the ties while maintaining mechanical details and general geometry which are consistent with existing ties and cribs.

SUMMARY OF THE INVENTION

According to the invention, rodding for the moveable rail or moveable point is housed in two elongated channels which have the footprint of a standard North American tie. A lock and detector rods are housed in one of the channels while the throw rod is housed in the other channel. The two channels are sufficiently spaced apart so as not to interfere with mechanical tampers. Switch plates straddle the flanges of each channel and the moveable rails or points are mounted on the switch plates. Rod adapters and switch clips provide a sliding connection to the moveable rails or points. The rods are made of insulating material and the switch plates and associated components include insulation to avoid cross conduction between the rails.

In one of its aspects, the invention comprises a hollow tie assembly for trackwork rodding comprising two elongated channels in spaced apart, parallel relationship, each of said channels having a base and side walls, each of the channels having a rod disposed therein and at least one plate extending across and being secured to both of the channels.

In another aspect of the invention, the base of the channels has a width not exceeding 15 inches and the centerlines of the channels are not less than 20 inches apart.

An assembly as in claim 1 wherein said at least one plate comprises a switch stand plate and a crank stand plate, each of which extends across and is secured to both of said channels thereby maintaining a spaced relationship between the channels.

In another aspect of the invention, the throw rod and the lock rod are made of a non-conducting material. In yet a further aspect, an insulating pad is provided between the switch plate and the channel.

In another aspect of the invention, rod adapters are provided and switch clips are slidingly secured to the rod adapters by means of a slip joint.

Other aspects of the invention will be appreciated by reference to the detailed description of the preferred embodiment and by reference to the claims.

BRIEF DESCRIPTION OF THE DRAWINGS

The preferred embodiment of the invention will be described by reference to the drawings in which:

FIG. 4(*b*) is a perspective view of a lock rod adapter according to the invention;

DETAILED DESCRIPTION OF THE BEST MODE AND PREFERRED EMBODIMENT OF THE INVENTION

Figure 1:
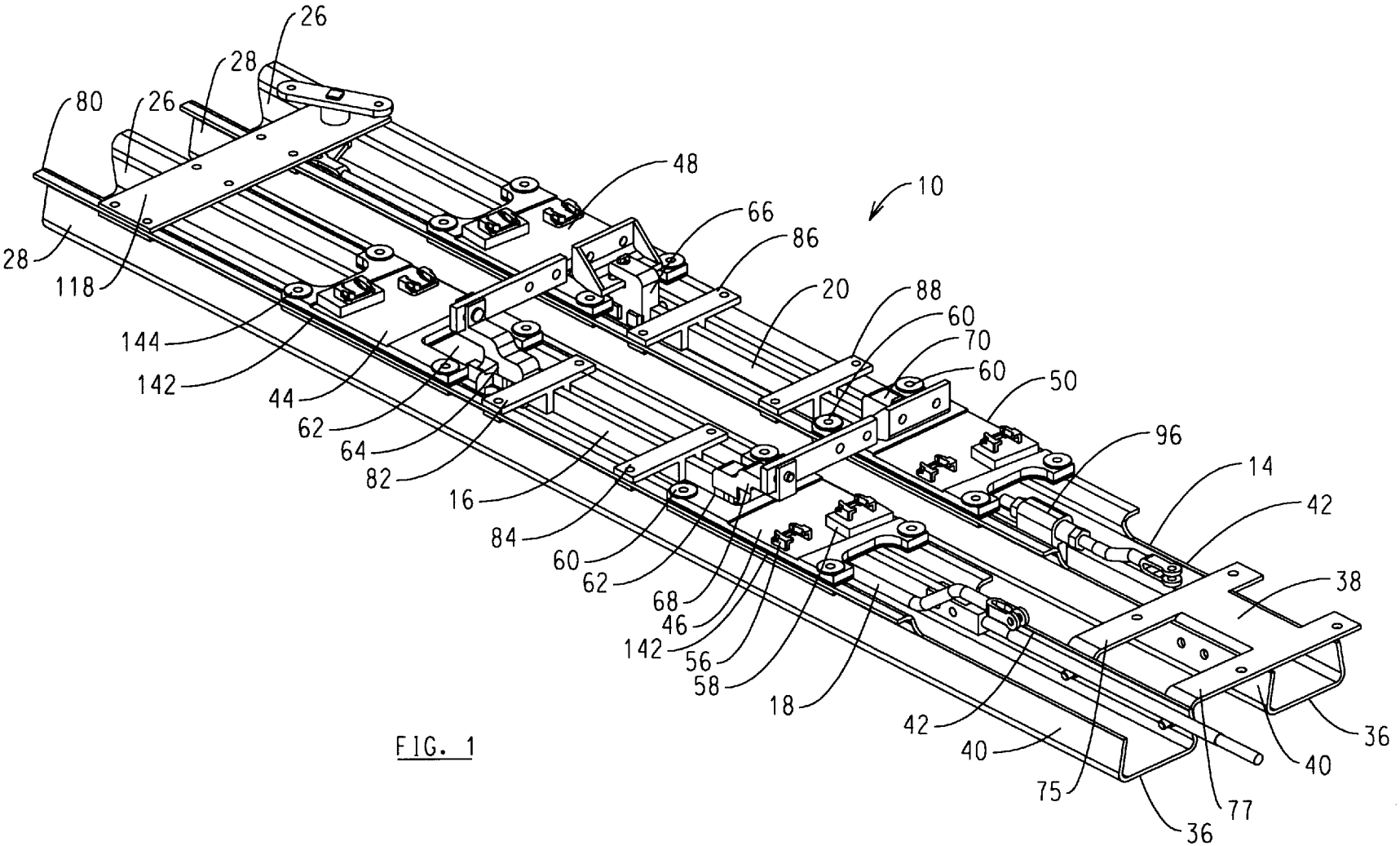
FIG. 1 is a perspective view of the assembly according to the invention.

Referring to FIG. 1, the overall switch assembly according to the invention is designated by the numeral 10.

Two channel-shaped hollow steel ties 12, 14 are arranged in spaced, parallel relationship. A lock rod 16 and a detector rod 18 are located in the channel of tie 12 while the throw rod 20 is located in the channel of tie 14.

Figure 2:
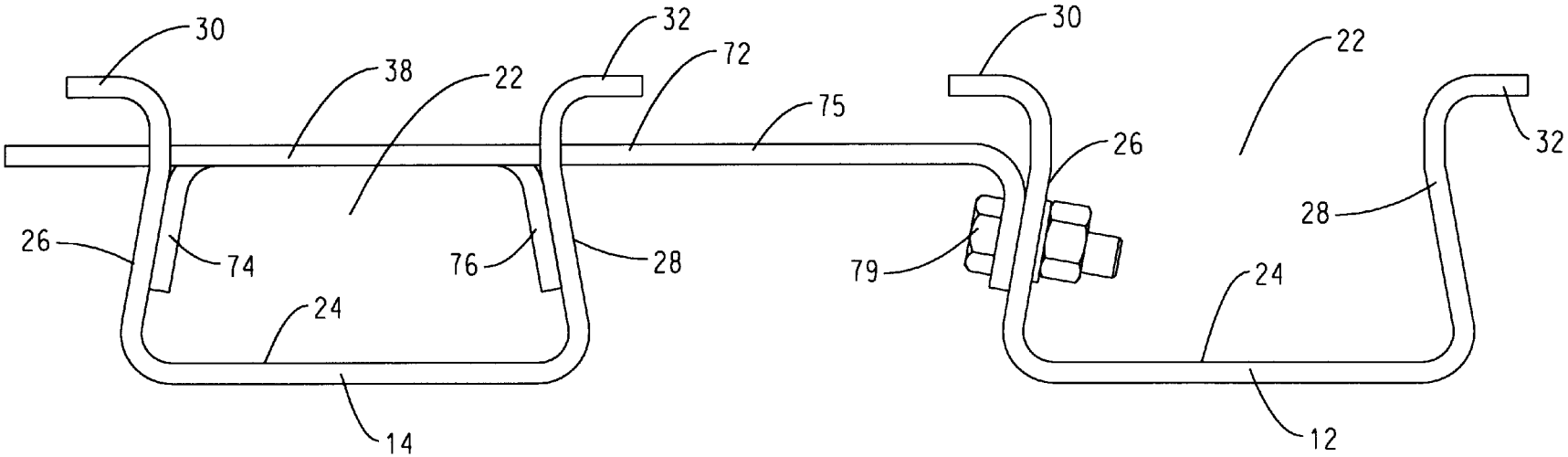
FIG. 2 is a cross sectional view of two channel-shaped ties and a switch stand plate mounted thereon according to the invention.

As best illustrated in FIG. 2, ties 12, 14 comprise a channel 22 defined between a flat base 24 and inwardly tapering side walls 26, 28 extending upward from the base 24. The upper edges of sides 26, 28 curve into outwardly extending flat flanges 30, 32. Flanges 30, 32 are provided with spaced holes for securing the other components of the assembly 10 to the ties.

Flanges 30, 32 do not extend the full length of the tie. Preferably, no flanges are provided for a short distance from one end 36 of the tie. This distance should be at least the longitudinal extent of the switch stand plate 38 that is described in more detail below. In addition to the absence of flanges, the flangeless portion of the tie has side walls 40, 42 that are shorter than side walls 26, 28. As a result, the height of the flangeless portion of the tie is reduced in relation to the rest of the tie. The foregoing profile of a hollow tie is known in the prior art in relation to the use of a single hollow tie in association with a single rod.

According to the invention, both of ties 12, 14 are formed as identical parts such that with appropriate drilling and plate attachment their formed parts may be used interchangeably for seating the throw rod or the detector and lock rods. The same structure of tie can also be used for the assist rods thereby allowing for mechanical tamping and the use of ballast near the assist rods.

The ties 12, 14 according to the invention are made a maximum of 15 inches wide at their widest area with centerlines not less than 20 inches apart to accommodate the tamper paddles of mechanical tamping equipment. Preferably the widest area is no more that 14 inches wide to avoid damage from misaligned tamper paddles.

Figure 3:
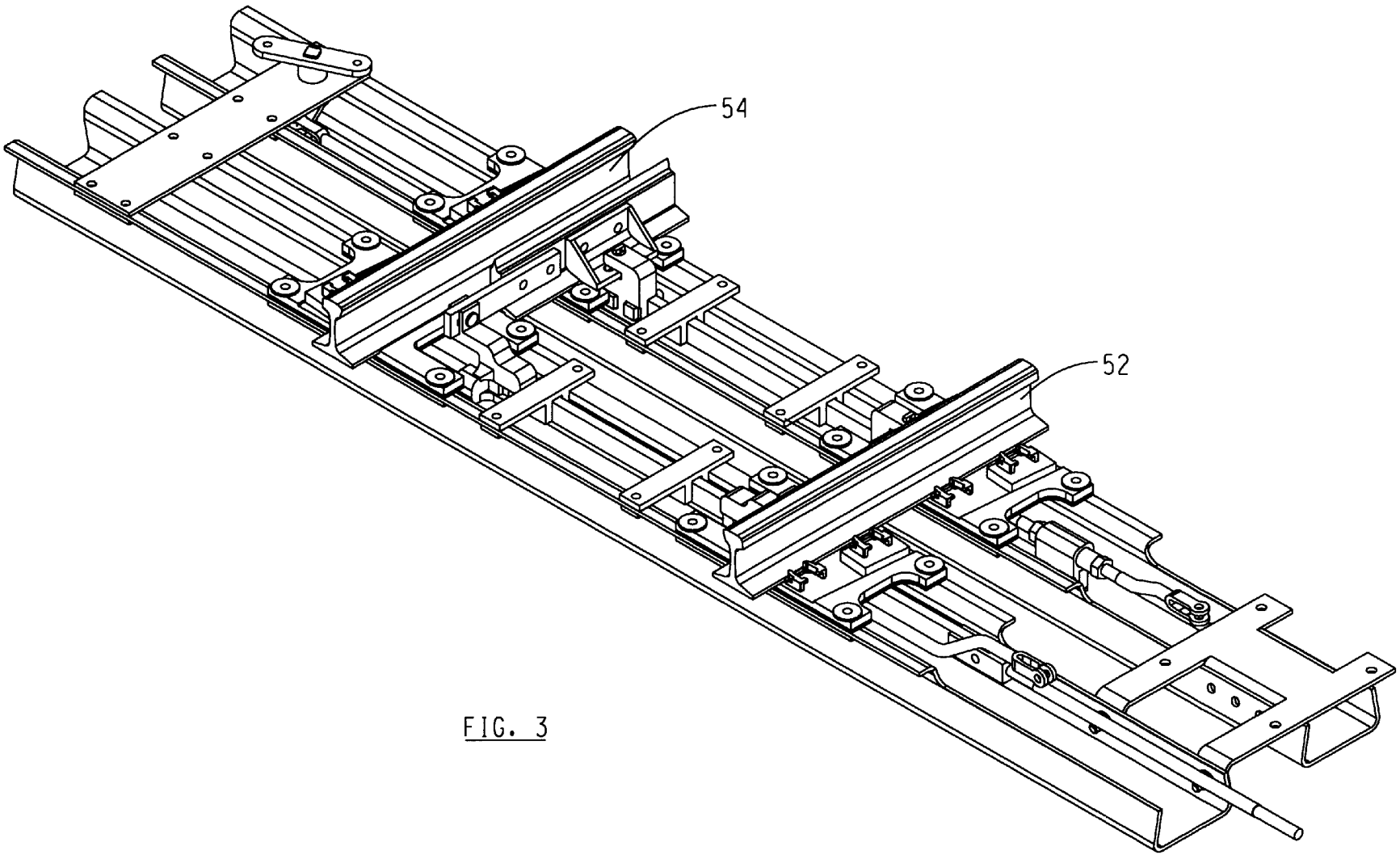
FIG. 3 is a perspective view of the assembly according to the invention, showing also the relative positions of the stock and switch rails.
Figure 4A:
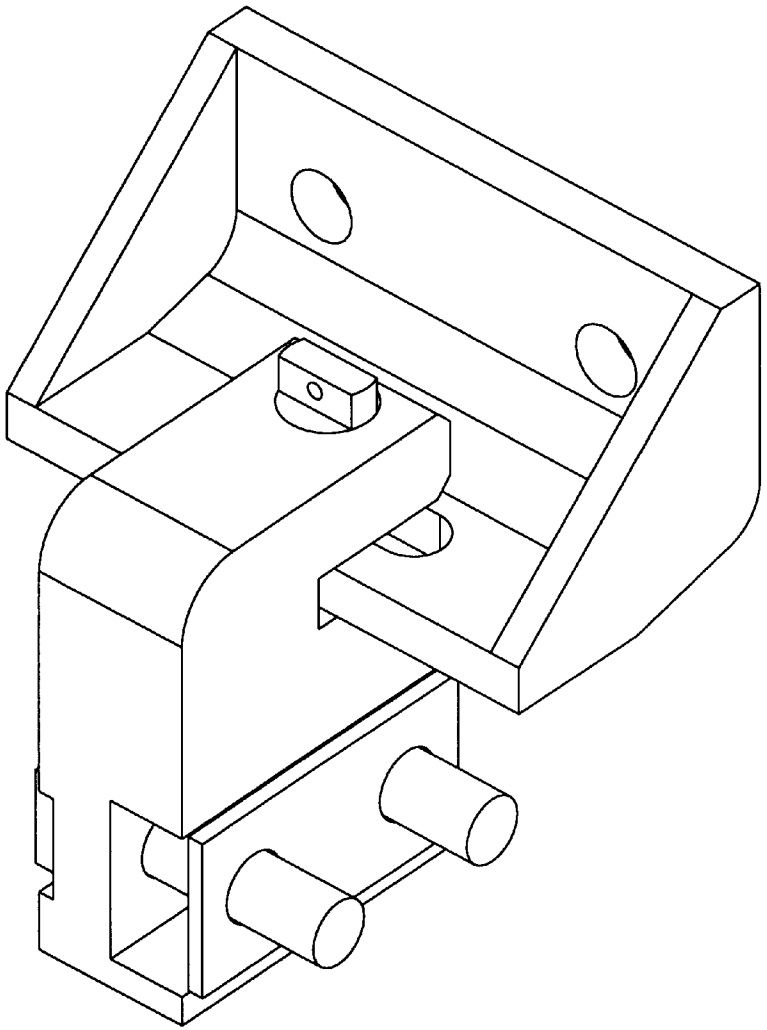
FIG. 4(*a*) is a perspective view of a throw rod adapter according to the invention.
Figure 4B:
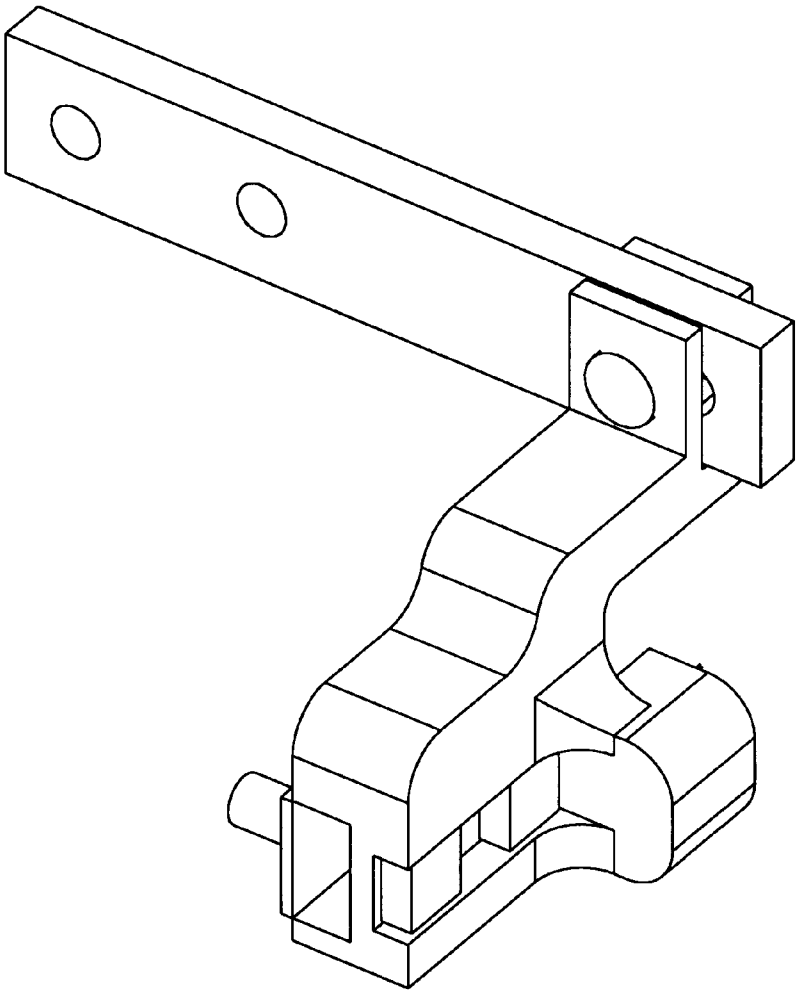

Referring again to FIG. 1, four switch plates 44, 46, 48 and 50 are mounted on ties 12, 14. Each of the ties has two switch plates for locating the assembly in relation to each of two stock rails 52, 54. The relative position of the stock rails and switch plates is best illustrated in FIG. 3.

Each switch plate includes a shoulder 56 for abutment of the stock rail and a second shoulder 58, recessed from the shoulder 56, for securement thereto of the rail brace (not shown). Each switch plate is secured to the tie by means of rivets, bolts, Huckbolts (trademark) or other mechanical fasteners 60 extending through each comer of the switch plate as well as through the underlying flanges 30, 32.

Each switch plate includes a slot 62 the width of which corresponds approximately to the width of the channel 22 between flanges 30 and 32. The slot 62 is provided to allow the rod adapters 64, 66, 68, 70 to extend as close as possible to the web of the rails while avoiding the need for unduly long adapters to reach across the breadth of the switch plate.

A switch stand plate 38 is mounted across the flangeless portion of tie 14. As the flangeless portion of the tie is of reduced height in relation to the rest of the tie, this allows switch stand plate 38 to be seated fairly low such that when a switch machine is attached to the switch stand plate, the overall assembly presents a tighter profile. As best appreciated by reference to FIG. 2, switch stand plate 38 includes a flat top portion 72 and two downwardly extending brace portions 74, 76 which are spaced so as to fit snugly against the interior of side walls 26, 28 of tie 14. The brace portions 74, 76 are designed to fit against the interiors of the side walls rather than against their exteriors so as to maintain a tighter profile for the overall assembly 10 and the ties 12, 14.

Switch stand plate 38 includes arms 75, 77 that extend laterally toward tie 12. Each arm 75, 77 terminates in an acutely angled flange 79 which angle corresponds to the angle of side wall 26 of tie 12 in relation to the vertical. Flanges 79 are mechanically fastened through side wall 26 by rivets, bolts, Huckbolts or other mechanical fasteners to thereby secure the ties 12, 14 in predetermined spaced relationship to one another.

A crank stand plate 118 is also mounted across ties 12, 14 at the end 80 of the ties which is distal from the flangeless end 36. These serve to maintain the ties 12, 14 a predetermined distance apart. As in the case of the switch plates, the crank stand plate is secured to flanges 30, 32 by means of rivets, bolts, Huckbolts or other mechanical fasteners.

Figure 5:
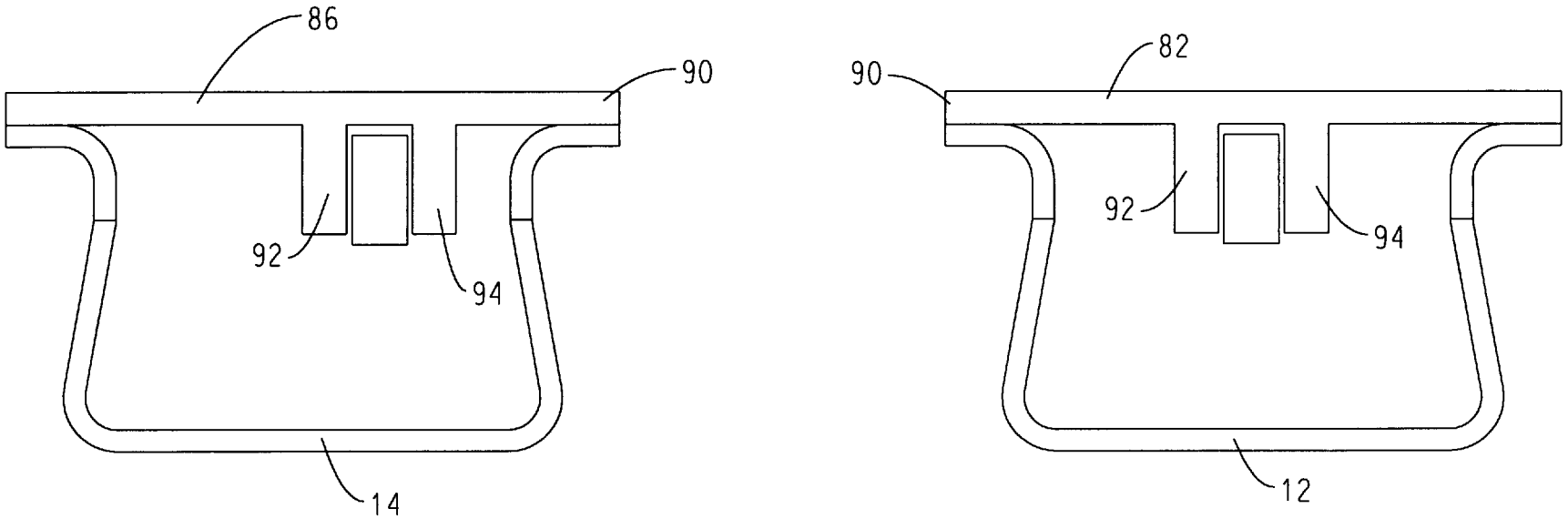
FIG. 5 is a cross sectional view of a rod guide according to the invention.

A pair of longitudinally spaced guides 82, 84 are provided in tie 12 and a second pair of guides 86, 88 are provided in tie 14. As shown in FIG. 5, each guide includes a support portion 90 extending across and secured to flanges 30, 32 and downwardly extending legs 92, 94 adapted to form a guideway for constraining the rods' lateral displacement perpendicular to the long axis of the hollow tie section.

As is known, a lost motion device 96, commonly referred to as a basket, may be associated with the throw rod. The basket enables a signal maintainer to adjust both the throw and total travel of the rod to account for differing design applications of the rods and total linkage length of the rod and to compensate for differing design locations of the switch machine to the moveable rails. In the prior art, the basket has been located between the rails. Positioning the basket between the rails results in limited accessibility due to hot air ducts used for snow removal that are frequently mounted between the rails over the top of the basket. In addition, the signal maintainer must place himself in the direct path of oncoming rail traffic to service or adjust the device. However, according to the preferred embodiment of the invention, rather than being located between the rails, the basket is located on the outward side of the rails as illustrated in FIG. 3. This provides greater accessibility without requiring the removal of hot air ducts or other hardware, or positions the signal maintainer to the side of the direct path of a train while adjusting or servicing the device.

Figure 6:
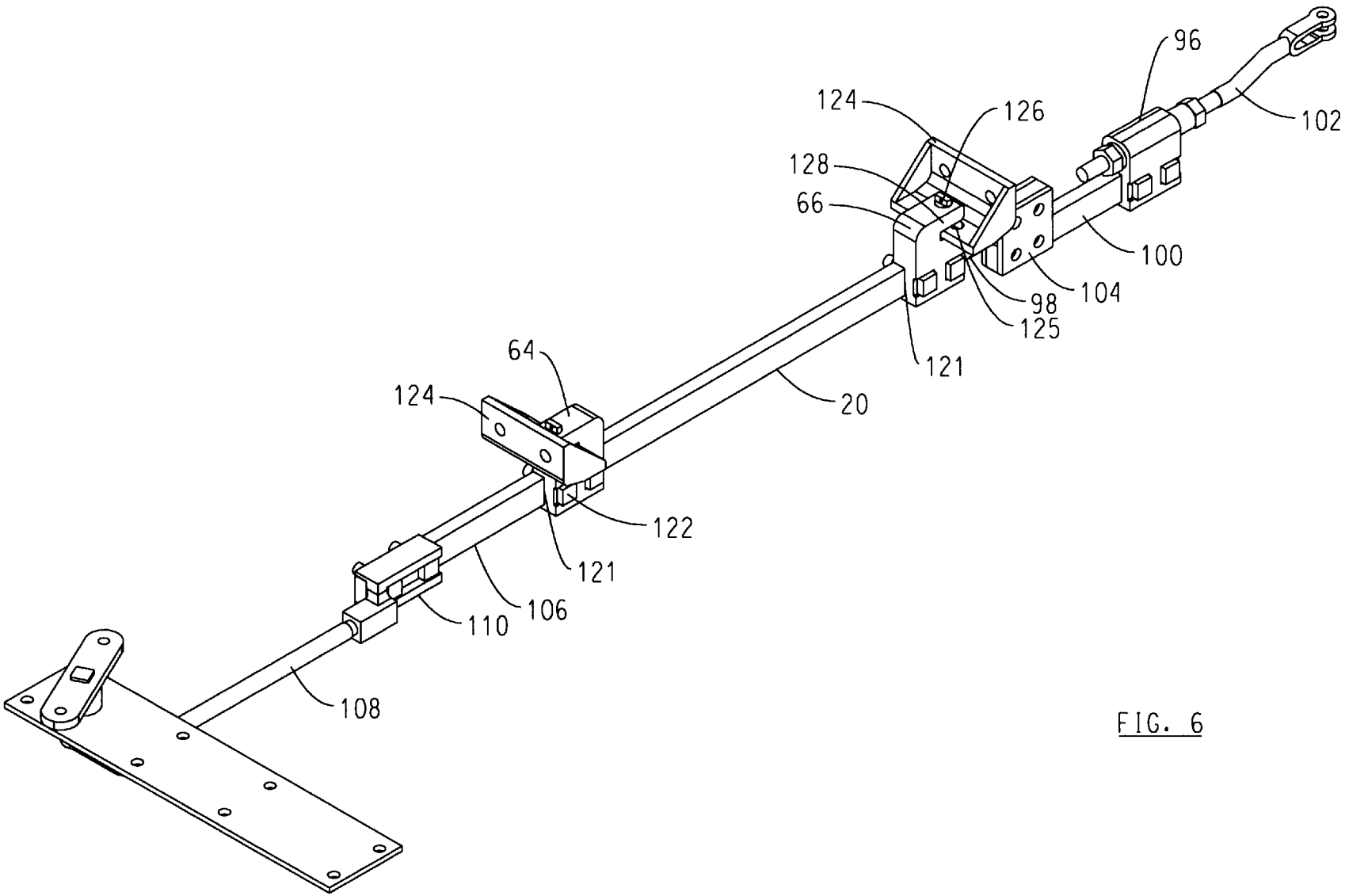
FIG. 6 is a perspective view of the throw rod assembly according to the invention.

Referring to FIG. 6, one end 98 of throw rod 20 is attached to a connecting rod 100 by means of a splice plate 104. The connecting rod 100 is in turn connected to the basket 96. Basket 96 is in turn connected to the shaft 102 of a switch machine (not shown). The basket 96 is arranged to be parallel to the longitudinal axis of the throw rod 20 but vertically offset in relation to it. This allows the operator relatively easy access to the basket for adjustment purposes, without being hindered by the basket being seated too deeply into the channel 22.

Figure 7:
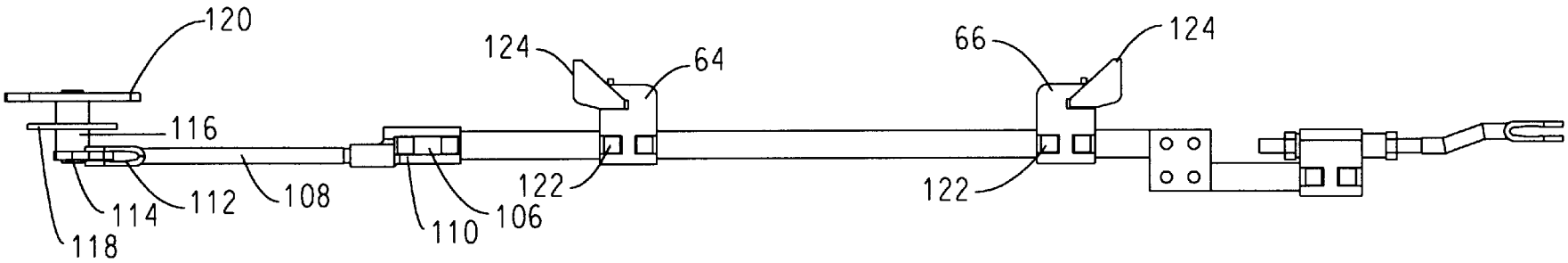
FIG. 7 is a side elevation of the throw rod assembly according to the invention.

Referring to FIG. 6 and FIG. 7, end 106 of throw rod 20 is attached to a crank actuating rod 108 by means of an offset adapter 110. Crank actuating rod 108 and offset adapter 110 are located in channel 22. Crank actuating rod 108 attaches by means of a clevis 112 to crank lever 114 that is connected to shaft 116. Shaft 116 extends through crank stand plate 118 to crank arm 120.

Referring to FIG. 6, the throw rod 20 includes two rod adapters 64, 66. Adapters 64, 66 are located on the portions of the throw rod which are adjacent the switch rails. The adapters are secured to the rod by means of rivets, bolts or Huckbolts 122 in possible combination with cement, extending through a U-shaped portion 121 of the adapter, which straddles the rod. A switch clip 124 is attached to the upper end of the adapter. Switch clip 124 includes a horizontal portion and a vertical portion. The horizontal portion includes a slot 125 that is parallel to the longitudinal axis of the rails (i.e. transverse to the longitudinal axis of the ties). A pin 126 extends downward through a C-shaped arm 128 of the adapter and through the slot 125. This provides a slip joint that allows limited relative movement between the switch rail and the rod. The vertical portion of the switch clip 124 is provided with holes to receive bolts that extend through the web of the switch rail, thereby securing the switch rail to the throw rod 20.

Figure 8:
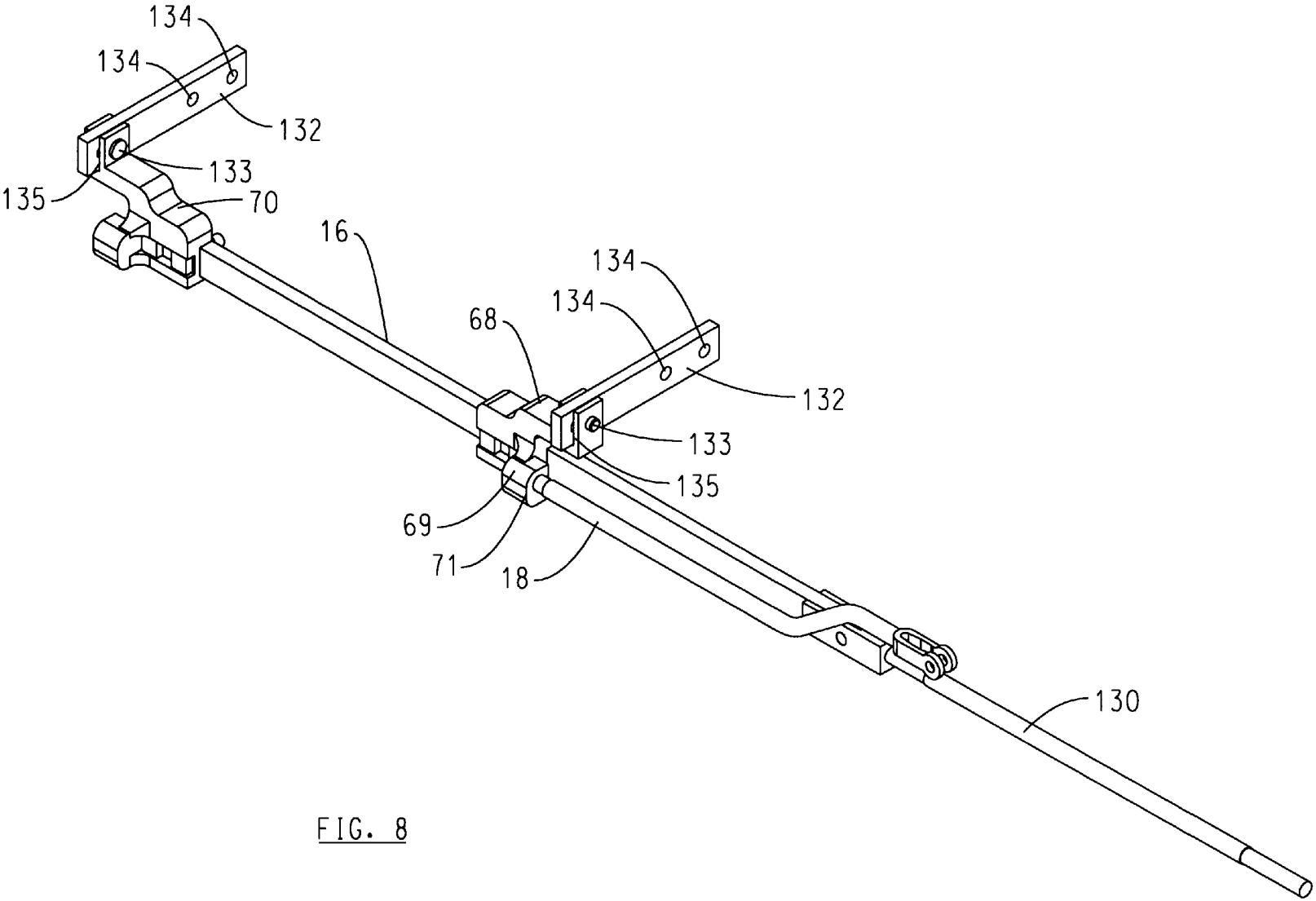
FIG. 8 is a perspective view of the lock and detector rod assembly according to the invention.
Figure 9:
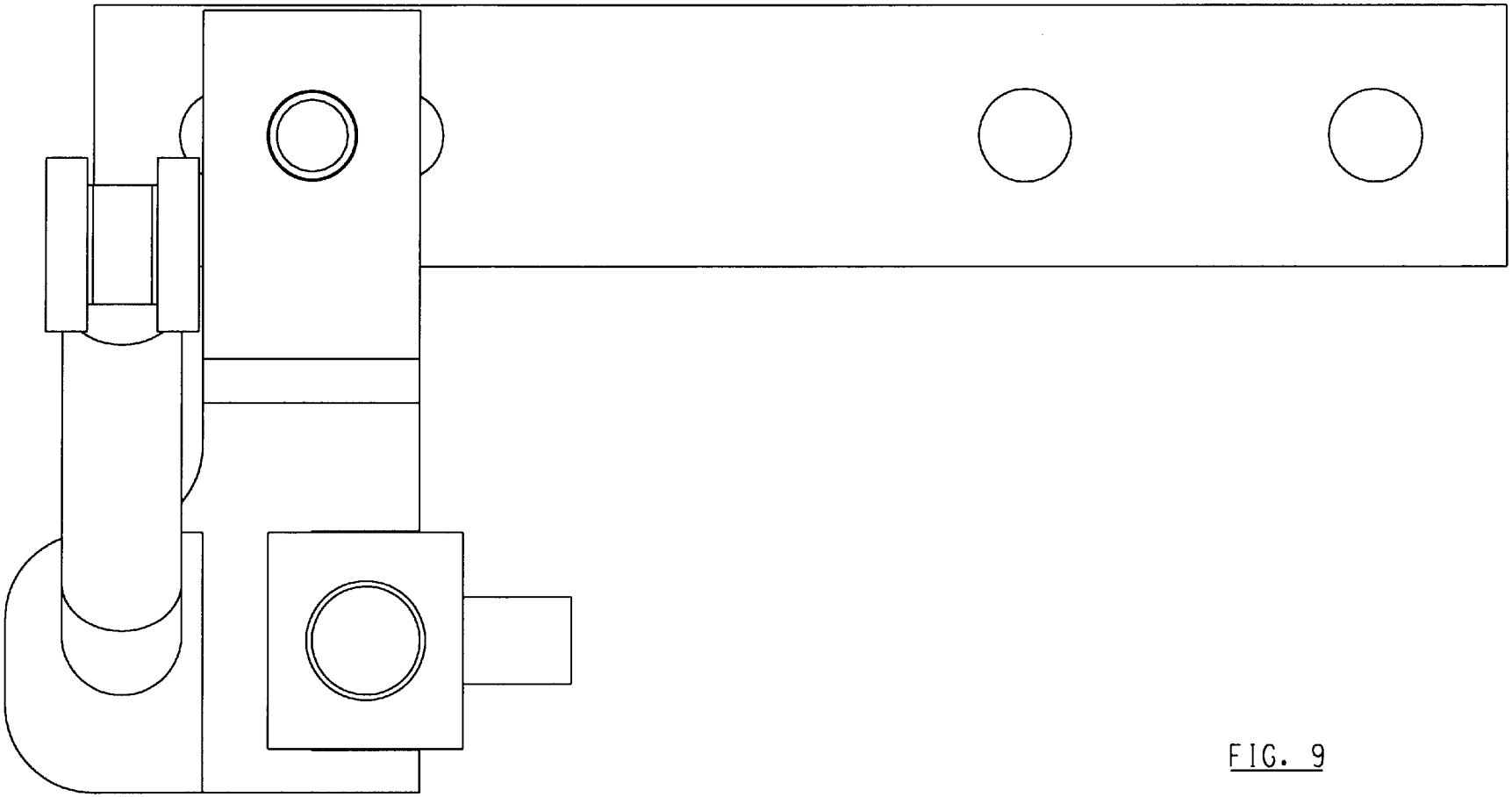
FIG. 9 is an end view of an adapter, retaining arm and detector rod connection according to the invention; and, FIG. 10 is a end view of the switch assembly according to the invention taken from the crank end of the assembly.
Figure 10:
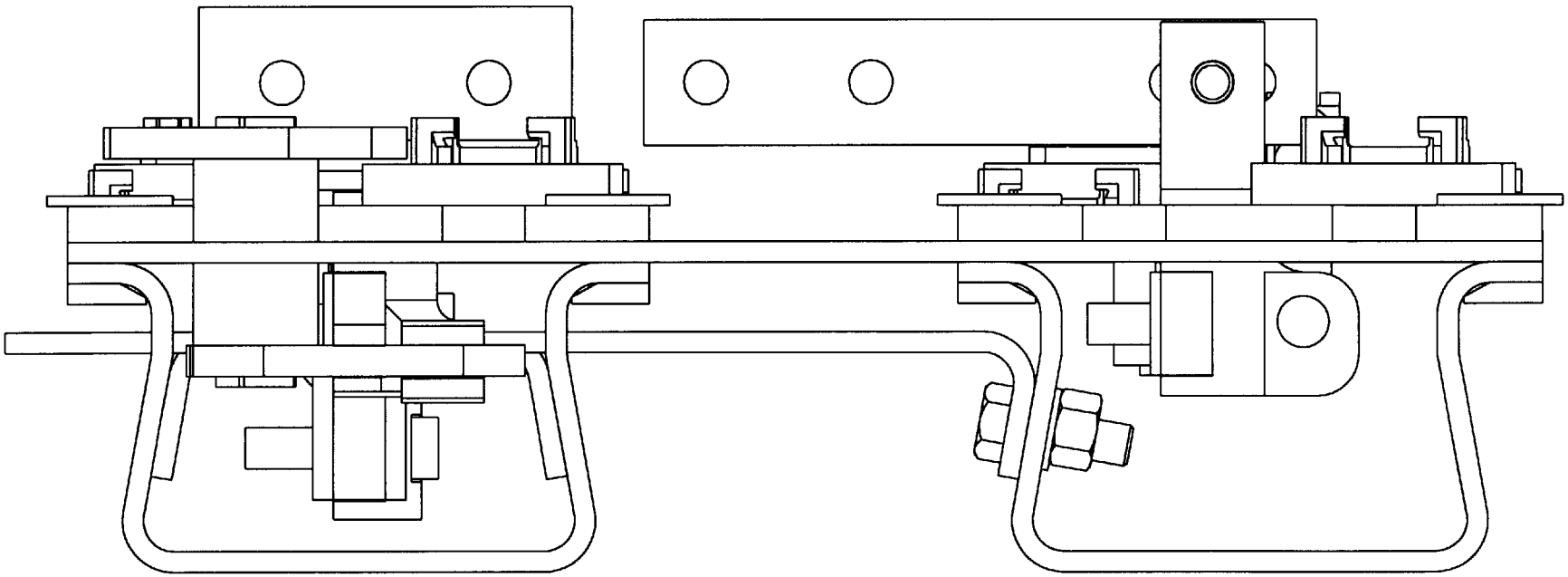

Turning now to the lock rod 16 as shown in FIG. 8, one end is connected to a lock actuating rod 130. Lock rod 16 includes two rod adapters 68, 70 which are located in the portions of the lock rod, which are adjacent the switch rails. They are secured to the rod by means of bolts extending through a U-shaped portion of the adapter that straddles the rod. A retaining arm 132 is attached to an upper, U-shaped end 135 of the adapter and is provided with a laterally elongated slot to receive a pin 133. This allows relative lateral sliding movement of the switch rails and the switch assembly. Holes 134 are provided in the retaining arm to receive bolts that extend through the web of the moveable rail.

The provision of slip joints in the switch clips 124 and the retaining arms 132 is particularly useful for larger turnouts where the longer lengths of rail involved have a greater capacity for thermal expansion and contraction.

Adapter 68 includes a laterally extending shoulder 69 that is provided with a threaded hole 71 for receiving the end of detector rod 18.

Specific aspects of the hollow tie according to the invention are directed to avoiding electrical conduction between the rails through the hollow tie. In the prior art, electrical conduction through the rods is typically avoided by fabricating the rod in multiple short lengths and connecting individual components using a coupler that includes an electrically insulating material. As best illustrated in FIG. 1, the invention includes an insulating pad 142 is sandwiched between the tie plates and the flanges of the hollow ties. Electrically insulating flanged bolt sleeves 144 extend through the holes in the tie plate and through the hollow tie flanges 30, 32. In addition, in the invention the lock rod and throw rods are made completely of an electrically insulating material. In the preferred embodiment the rods are made of insulating pulltruded fiber. Connection of the throw rods, lock rods and detector rods to the moveable rails is arranged so that the rod adapters and switch clips are suspended above the bottom of the hollow tie section effectively preventing any contact with the ties and electrical short circuit. Thus, due to the large air gap, and the fact that the rods are made of insulating material, electrical conduction between the moveable rails and the hollow tie sections through the switch clips is prevented.

The hollow tie of the present invention is not limited to use in switches but may also be used in other movable trackwork such as movable point frogs. It will also be appreciated by those skilled in the art that while the preferred embodiment of the invention has been described in detail, variations to the preferred embodiment may be practised without thereby departing from the scope of the invention, which scope is reflected in the foregoing disclosure and in the following claims.

What is claimed is:

1. A hollow tie assembly for trackwork rodding comprising:

two parallel elongated channels at least one rigid plate interconnecting said channels and maintaining a predetermined spacing between them equivalent to the standard spacing between rail ties in the vicinity of a switch;

each of said channels having a base and side walls and having at least one switch rod disposed therein.

2. An assembly as in claim 1 wherein a throw rod is disposed in a first one of said channels and a lock rod is disposed in a second one of said channels.

3. An assembly as in claim 2 further comprising a detector rod disposed in said second channel.

4. An assembly as in claim 2 further comprising a switch plate secured to each of said channels, said switch plate having a generally U-shaped slot extending between said side walls and being adapted to accommodate an upwardly extending portion of a rod adapter in said slot.

5. An assembly as in claim 2, further comprising a lost motion device attached to said throw rod and disposed near an end of said first channel.

6. An assembly as in claim 5 wherein said lost motion device has a longitudinal axis and said longitudinal axis is parallel to, but vertically offset in relation to the longitudinal axis of the throw rod.

7. An assembly as in claim 2 wherein said throw rod and said lock rod are made of a non-conducting material.

8. An assembly as in claim 7 wherein each of said channels further comprises at least one switch plate secured to said channel and an insulating pad between said switch plate and said channel.

9. An assembly as in claim 8 wherein said switch plate is secured to said channel by means of bolts extending through insulating sleeves.

10. An assembly as in claim 8 wherein said throw rod and said lock rod each have one end attached to a moveable rail by means of a rod adapter and said rod adapter is suspended out of direct contact with the channel.

11. An assembly as in claim 2 further comprising two rod adapters connecting said throw rod to means for attaching to at least one moveable rail or moveable point.

12. An assembly as in claim 11 wherein said adapters are slidingly secured to a switch clip which is in turn adapted to be secured to a moveable rail and said sliding securement is achieved by means of a slip joint between the adapter and the switch clip.

13. An assembly as in claim 1 wherein said base has a width not exceeding 15 inches and centerlines not less than 20 inches apart.

14. An assembly as in claim 1 wherein said at least one plate comprises a switch stand plate and a crank stand plate, each of which extends across and is secured to both of said channels thereby maintaining a spaced relationship between the channels.

15. A hollow tie assembly for trackwork rodding comprising two elongated channels in spaced apart, parallel relationship, each of said channels having a base and side walls, and outwardly extending flanges at the upper edges of said side walls;

a throw rod disposed in a first one of said channels;

a lock rod and a detector rod disposed in a second one of said channels;

at least two switch plates, each of said switch plates being associated with one of said channels and extending across the outwardly extending flanges of its associated channel;

a first rod adapter attached to one end of said throw rod, said rod adapter extending upwards from said rod end to the level of a first one of said switch plates associated with said channel containing said throw rod and so as to define an upper end of said rod adapter, said upper end of said rod adapter being adapted for sliding connection to a switch clip;

a second rod adapter attached to said throw rod, said rod adapter extending upwards from said rod to the level of a second one of said switch plates associated with said channel containing said throw rod and so as to define an upper end of said rod adapter, said upper end of said rod adapter being adapted for sliding connection to a switch clip;

a switch stand plate extending across at least one of said channels and being secured to both of said channels;

at least one rod guide mounted on said first channel for maintaining said throw rod out of contact with said side walls; and, a lost motion device attached to the other end of said throw rod, said other end of said throw rod being located on the outside of the rails.

16. An assembly as in claim 15 further comprising a crank stand plate which spans and is secured to both of said channels.

* * * * *